US007832310B2

(12) United States Patent
Junkers

(10) Patent No.: US 7,832,310 B2
(45) Date of Patent: Nov. 16, 2010

(54) TORQUE POWER TOOL

(76) Inventor: John K. Junkers, 14 Algonquin Trail, Saddle River, NJ (US) 07458

( * ) Notice: Subject to any disclaimer, the term of this patent is extended or adjusted under 35 U.S.C. 154(b) by 157 days.

(21) Appl. No.: 12/325,815

(22) Filed: Dec. 1, 2008

(65) Prior Publication Data

US 2010/0011912 A1 Jan. 21, 2010

Related U.S. Application Data

(60) Provisional application No. 61/081,765, filed on Jul. 18, 2008.

(51) Int. Cl.
*B25B 21/00* (2006.01)

(52) U.S. Cl. ..... 81/54; 81/52

(58) Field of Classification Search ..... 81/52, 81/54, 57.4, 57.44
See application file for complete search history.

(56) References Cited

U.S. PATENT DOCUMENTS 3,970,110 A * 7/1976 Schaedler et al. ..... 137/613
4,565,312 A * 1/1986 Berry ..... 227/8
4,959,906 A * 10/1990 Moore, Jr. ..... 30/381
6,152,243 A 11/2000 Junkers
6,253,642 B1 7/2001 Junkers
6,715,381 B2 * 4/2004 Junkers ..... 81/57.39

* cited by examiner

*Primary Examiner*—David B Thomas
(74) *Attorney, Agent, or Firm*—Michael J. Striker

(57) ABSTRACT

A hand-held torque power wrench for tightening and loosening fasteners, the torque power tool has a motor, a housing, at least one handle configured to hold the torque power wrench in a position and to pull a trigger with one hand of an operator, and a safety device operatable by the other hand of the operator, so that when it is operated by the other hand of the operator the torque power wrench is functioning to tighten or loosen the fastener, but when the only one hand of the operator is used for holding the torque power wrench in position and pulling the trigger, the torque power wrench is not functioning to tighten or loosen the fastener.

9 Claims, 5 Drawing Sheets

TORQUE POWER TOOL

CROSS REFERENCE

This application claims the benefit of priority of U.S. Provisional Patent Application Ser. No. 61/081,765 filed Jul. 18, 2008 under 35 USC 119(e). The subject matter of the aforesaid U.S. Provisional Patent Application is further explicitly incorporated herein by reference thereto.

BACKGROUND OF THE INVENTION

The present invention relates to torque power tools.

Power tools are known in the art. One of such known tools is a pneumatic torque power tool. Other torque power tools are known to be driven electrically, hydraulically, manually or otherwise powered. Every torque power tool has an action force and an equal and opposite reaction force. In any of torque tools such as a pneumatic torque tool, a torque multiplier, an electric or hydraulic torque tool, the action force equals a reaction force in opposite direction. As tightening of fasteners is becoming a more precise art, accurate or at least even bolt loads is a requirement. However, this can not be accomplished with slugging wrenches or impact wrenches.

Torque power tools require a reaction arm to abut against an adjacent stationary object, so as to stop the tool from turning around a bolt and to turn a nut instead. In such torque power tools, the reaction arm is usually connected around an axis, and a mechanism is provided to hold the arm steadily relative to the tool housing during operation. This can be done with splines, hexagons, or other configurations.

The reason that torque power tools include a reaction arm is that the tools are unable to tighten and loosen fasteners, e.g., a nut, unless the tool housing is stopped from turning in the opposite direction. This means that the equal and opposite reaction force to the nut turning force has to be diverted for a torque power tool to function properly. Several examples of known torque power tools that include a reaction arm to abut against a stationary object are disclosed in U.S. Pat. No. 6,152,243, U.S. Pat. No. 6,253,642 and U.S. Pat. No. 6,715,381, commonly owned and incorporated by reference herein.

In known torque power tools with a reaction arm there is a significant risk that during intended use, operator's fingers or hand might be caught between the reaction arm and the abutment area when not paying attention. The stationary object or abutment area against which the necessary reaction arm abuts can be one of adjacent nuts, a housing of the application, a pipe of which the flange is part, etc.

The operator grasps the tool with an operating hand that also trigger torque tool operation. The hand other than the operating hand is free and might inadvertently move to the reaction arm, or proximate to the reaction arm at which the free hand can be caught as the reaction arm moves against a stationary object to find it abutment area while the operator triggers and activates the torque tool by the operating hand. This is one of the greatest dangers in bolting with torque power tools, and it happens frequently, since the reaction force applied by the tool is in most cases much larger than the LBS/FT torque as the portion of the reaction arm that abuts is often less than one-quarter of a foot away from the turning axis of the tool. Tools of this kind have and will amputate fingers. See page 5.

Injury to the free hand and its fingers known to be severe. Such accidents occur frequently, and require attention. At times not only the operator's work is stopped in response to injury, but an entire operation must stop. Anyone proximate an injury to a workforce member normally directs their attention to the injury, and the injured operator. So not only has the operator been injured and hurt, but the cost to the job or work task and loss in productivity is enormous. For that matter, such workforce accidents are normally subject to OSHA reporting requirements.

SUMMARY OF THE INVENTION

Accordingly, it is an object of the present invention to provide a torque power tool which avoids the disadvantages of the prior art.

In keeping with these objects and with others which will become apparently hereinafter, one feature of the present invention resides, briefly stated, in a hand-held torque power wrench for tightening and loosening fasteners, comprising a motor; a housing; at least one handle configured to hold the torque power wrench in a position and to pull a trigger with one hand of an operator; and a safety device operatable by the other hand of the operator, so that when it is operated by the other hand of the operator the torque power wrench is functioning to tighten or loosen the fastener, but when said only one hand of the operator is used for holding the torque power wrench in position and pulling the trigger, the torque power wrench is not functioning to tighten or loosen the fastener.

In accordance with another feature of the present invention, the safety device is configured so that a reaction arm is non-rotatably connected with the housing when the safety device is operated by the other hand of the operator, but the reaction arm is disconnected from the housing when the safety device is not operated by the other hand of the operator and therefore, in the latter case, the reaction arm cannot divert a reaction force to the adjacent stationary object, so that the wrench cannot function.

Still, a further feature of the present invention resides, in a hand-held torque power tool, in which the safety device further includes a hand grip operatable by the other hand of the operator, so that when the hand grip is operated by the operator, the reaction arm is non-rotatably connected with the housing, but when the hand grip is released by the operator, the reaction arm automatically disconnects from the housing.

In accordance with a further feature of the present invention, the safety device includes an engaging element located substantially between the reaction arm and the housing and displaceable between a first position in which it non-rotatably connects the reaction arm with the housing and a second position in which it disconnects the reaction arm from the housing.

The safety device can further include spring means arranged so that when the hand grip is operated by the other hand of the operator, the engaging element is moved from the first position into the second position against a spring force, but when the other hand of the operator releases the hand grip, the spring means automatically displace the engaging element back from the second position into the first position.

In accordance with another embodiment of the present invention, the safety device can be configured so that when the other hand of the operator operates the safety device, it provides a power supply to the drive of the torque power wrench, for example to a motor, but when only one hand of the operator is used for holding the torque power wrench and pulling the trigger, the power supply to the drive is interrupted and the torque power wrench is not functioning to tighten or loosen the fastener. This safety device is usable for any torque power wrench, including electrical, hydraulic, pneumatic, etc.

For example for a torque power wrench with a fluid-operated (pneumatic or hydraulic) drive, the safety device can be configured so that when the other hand of the operator operates the safety device, it provides a supply of a working fluid to a fluid-operated drive, but when only one hand of the operator is used for holding the torque power wrench and pulling the trigger, the supply of the working fluid to the fluid-operated drive is interrupted and the torque power wrench is not functioning to tighten or loosen the fastener.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
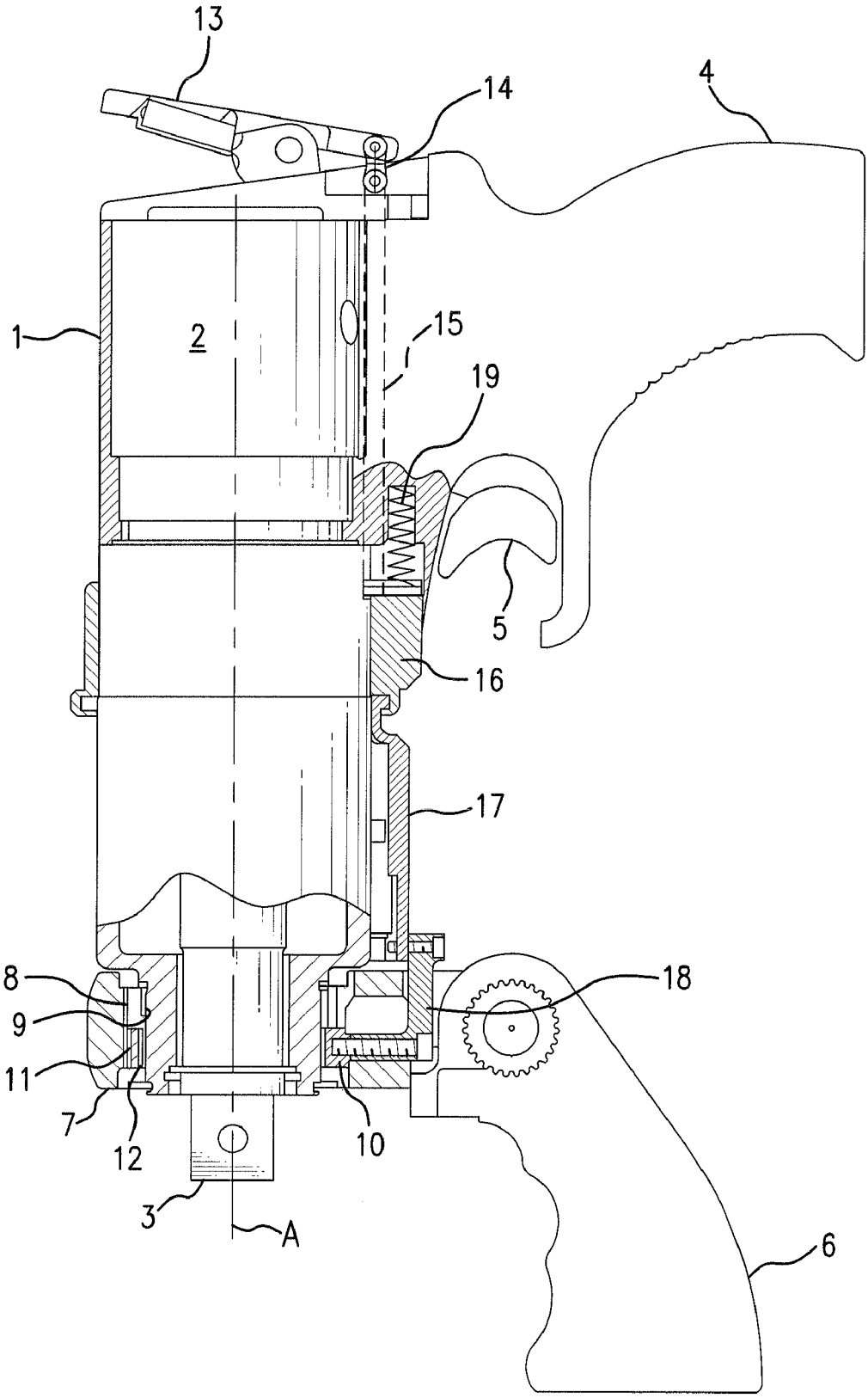
FIG. 1 is a view showing a cross section of a torque power wrench in accordance with one embodiment of the present invention.
Figure 2:
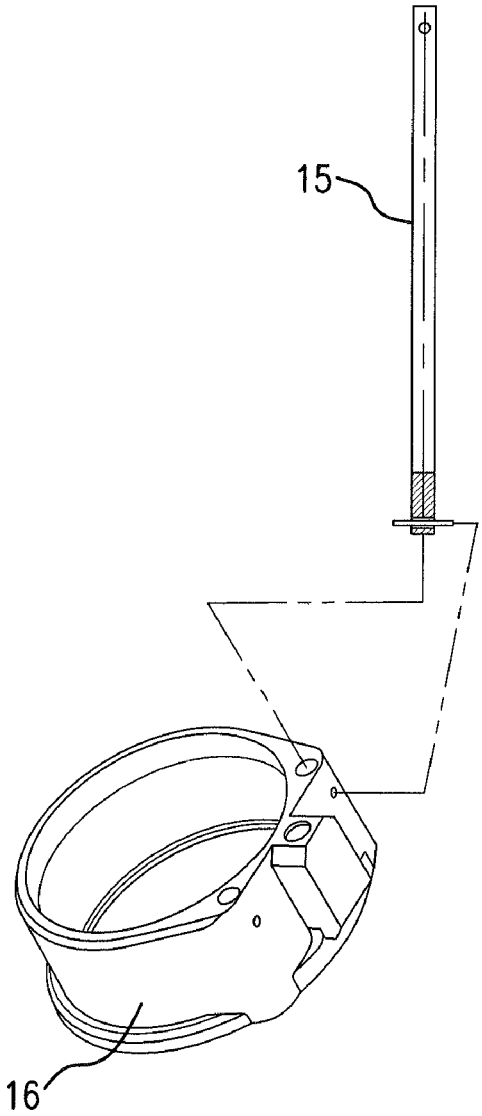
FIG. 2 is a view showing parts of a safety device of the inventive torque power wrench including a shifter rod and a sleeve.
Figure 3:
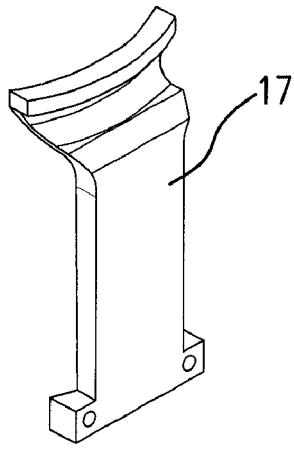
FIG. 3 is a view showing another part of the safety device of the inventive torque power wrench, in particular a shifter link.

A hand-held torque power wrench in accordance with the present invention has a housing which is identified with reference numeral 1 and accommodates a motor 2, that can be formed as a hydraulic, pneumatic, electric, etc. motor. A drive element 3 is driven in rotation by the motor 2 and engages a fastener to be tightened or loosened, so that when the motor 2 is actuated, the driving element 3 rotates and provides rotation of a corresponding fastener. The torque power wrench can be provided with torque intensifying means for increasing a torque output from the drive motor 2 to the driving element 3. The torque intensifying means can be formed as planetary gears which are located in the housing 1 and not shown in the drawings.

The torque power wrench further has a handle 4 for holding the torque power wrench in a position with one hand of an operator, with a trigger 5 for activating the torque power tool with the operator's one hand. The handle 4 is for example immovably connected with the housing 1. When an operator holds the handle 4 and pulls the trigger 5, the drive motor 2 is activated.

The torque power tool further has a reaction arm for abutting against an adjacent stationary object and diverting a reaction force generated during the operation to the adjacent stationary object. The reaction arm has a distal portion 6 configured to abut against the stationary object so as to the stop the tool from turning around a fastener, and a proximal portion 7 connectable with and disconnectable from the housing 1 of the torque power wrench, as will be explained below. The portions 6 and 7 of the reaction arm are connected with one another so that they are non-rotatable relative to one another around an axis A of rotation of the driving element 3.

The hand-held torque power wrench in accordance with the present invention has a torque output which exceeds a torque output counteractable by hand of an operator. In other words, the operator cannot stop the housing of the tool from turning under the action of a reaction force which is opposite to an action force provided by the driving element 3, but instead for functioning of the inventive torque power wrench the reaction arm must be always functional as well. It must be connected with the housing non-rotatably about an axis A of the housing 1 and of the driving element 3 and must abut against the adjacent stationary object.

In accordance with the present invention, the torque power wrench is provided with a safety device which is operatable by the other hand of the operator, and designed so that when it is operated by the other hand of the operator the torque power wrench is functioning to tighten or loosen the fastener, but when the only one hand of the operator is used for holding the torque power wrench in position by holding the handle 4 and pulling the trigger 5, the torque power wrench is not functioning to tighten or loosen the fastener.

In accordance with one exemplary embodiment of the present invention which is disclosed in this application, the safety device is configured so that when it is operated by the other hand of an operator, the reaction arm is connected with the housing and can abut against an adjacent stationary object during the functioning of the torque power wrench so as to stop the housing of the torque power wrench from turning around the fastener during tightening or loosening of the latter. The reaction arm is however disconnected from the housing when the safety device is not operated by the other hand of the operator and therefore, in the latter case the reaction arm cannot divert a reaction force to the adjacent stationary object.

Figure 4:
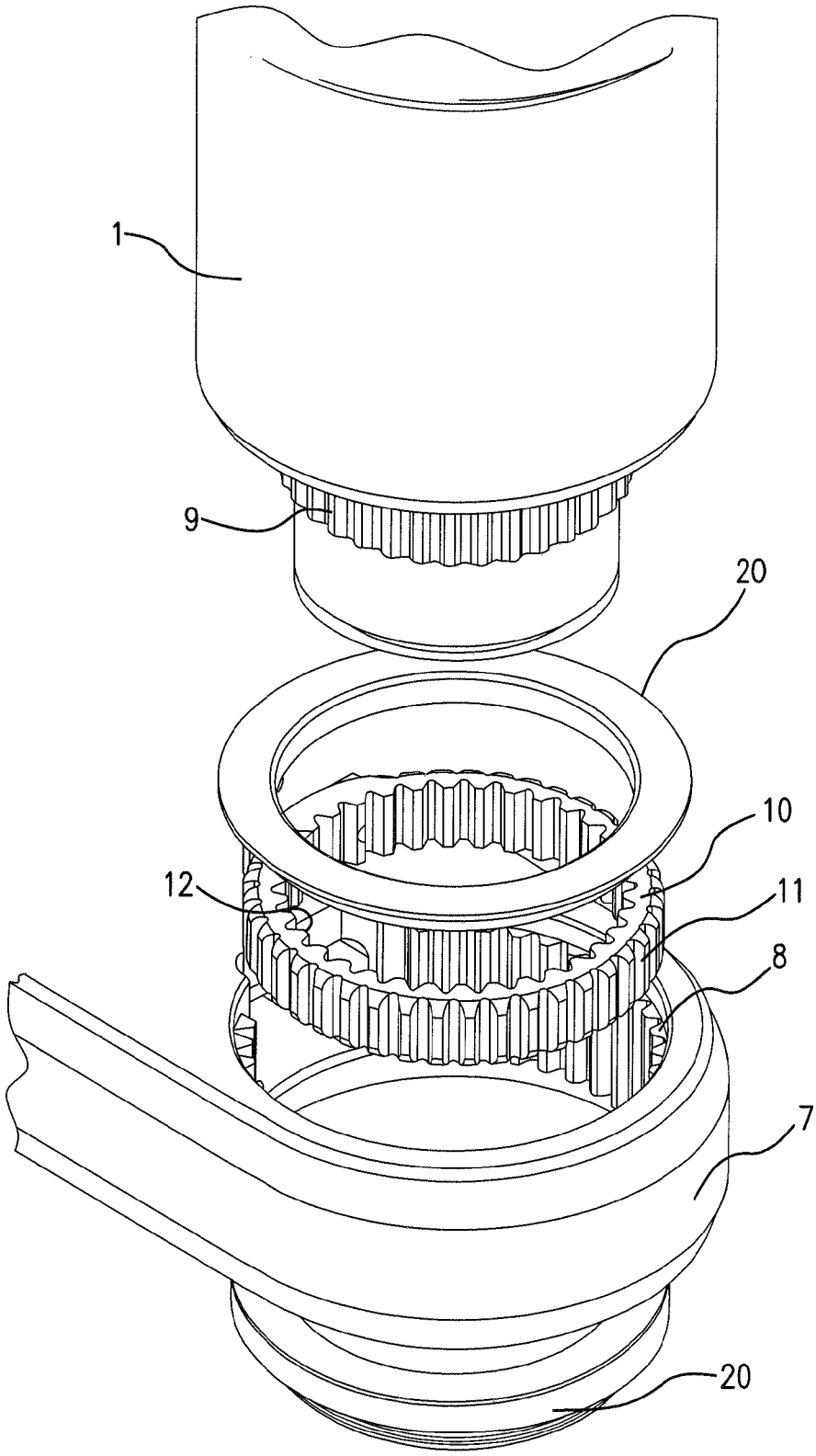
FIG. 4 is a view showing a region of engagement of a portion of a reaction arm with a portion of a tool housing of the inventive torque power wrench, on an enlarged scale.

As can be seen from FIGS. 1 and 4 the distal portion 7 of the reaction arm is provided with axially longer inner splines 8 while a portion of the housing 1 extending through the interior of the distal portion 7 is provided with axially shorter outer splines 9, configured so that the splines 8 and 9 are radially spaced from one another. The safety device mentioned hereinabove includes an engaging element formed for example as a ring 10 which is movable in an axial direction and has outer splines 11 which for example always engage with inner splines 8 of the distal portion 7 of the reaction arm, and also has inner splines 12 which for example are engagable with the splines 9 of the portion of the housing 1 and disengagable therefrom. Reference numeral 20 identify bearings provided in this region.

In the position shown in FIG. 1, the ring 10 is displaced axially downwardly so that its splines 12 do not engage with the splines 9 of the housing, and therefore the portion 7 of the reaction arm is not connected to the housing 1 non-rotatably around the axis A. In order to connect the reaction arm with the housing non-rotatably around the axis A, the ring 10 is displaced axially upwardly so that not only its splines 11 engage with the splines 8 of the reaction arm, but its splines 12 also engages with the splines 9 of the housing. The reaction arm becomes connected with the housing non-rotatably about the axis A. In this position when the distal portion 6 or the reaction arm abuts against a neighboring stationary object during the operation of the torque power wrench, the torque power wrench can function since a reaction torque output which cannot be counteracted by hand of an operator is counteracted by the reaction arm abutting against the adjacent stationary object.

In order to displace the ring 10 axially upwardly to provide engagement of the reaction arm with the housing, an operator acts on one leg of a hand grip 13, so that its other leg through a chain link 14 lifts a shifter rod 15. The shifter rod 15 lifts a sleeve 16, which in turn lifts a link 17, which then lifts a shifter 18 connected with the ring 10, so finally the ring 10 is lifted. As explained hereinabove, when the ring 10 is displaced upwardly, it provides the connection of the reaction arm with the housing, so that the reaction arm becomes connected with the housing non-rotatably around the axis A.

It is therefore believed to be understood that a torque power wrench can function only when both actions take place: an operator holds the handle 4 of the torque power tool in position and pulls the trigger 15 with one hand, and at the same time the operator operates the safety device by acting on the hand grip 13 with the other hand, and therefore his other hand cannot be in the region of the reaction arm.

When the operator does not act on the hand grip 13 with its other hand, a return spring 19 which was tensioned when the hand grip 13 was operated, relaxes. It displaces the elements 16, 17, and 18 axially downwardly, and the ring 10 is also displaced axially downwardly, so that its splines 12 are disengaged from the splines 9 of the housing, and the reaction arm no longer is non-rotatably connected to the housing.

The safety device for the hand-held torque power wrench in accordance with another embodiment can be formed for example so that when the other hand of the operator operates the safety device, it provides a power supply to the motor 2, but when only one hand of the operator is used for holding the torque power wrench in position by holding the handle 4 and pulling the trigger 5, the power supply to the motor 2 is interrupted and the torque power wrench is not functioning to tighten or loosen the fastener. This safety device can be used for the torque power wrenches with drives of different types, for example electric, pneumatic, hydraulic, and other drives. One example of this embodiment of the present invention is illustrated in FIGS. 5 and 6, which shows the safety device in two different positions.

In this embodiment the torque power wrench has means for supplying a working fluid (liquid or gas) to a motor 21 formed for example as an air motor and provided with a directional valve 22. The means for supplying the working fluid include a fluid inlet passage 23 through which the working fluid is supplied. An exhaust passage through which the working fluid is withdrawn is identified with reference numeral 24.

The safety device in accordance with the present invention includes a turnable hand grip 25 to be held by the other hand of an operator and which is provided with a return spring 26. An operator acts on an upper arm of the hand grip 25, while the lower arm is connected with a stem 27 which slides in a guide bushing 28 and is connected with a piston 29. The piston 29 is moveable transversely to the inlet passage 23 between a position shown in FIG. 5, in which it closes a throughgoing opening of the inlet passage 23 and prevents the working fluid from flowing into the air motor 21, and a position shown in FIG. 6 in which it opens the opening of the inlet passage 23 to allow a flow of the working fluid into the air motor 21.

Figure 5:
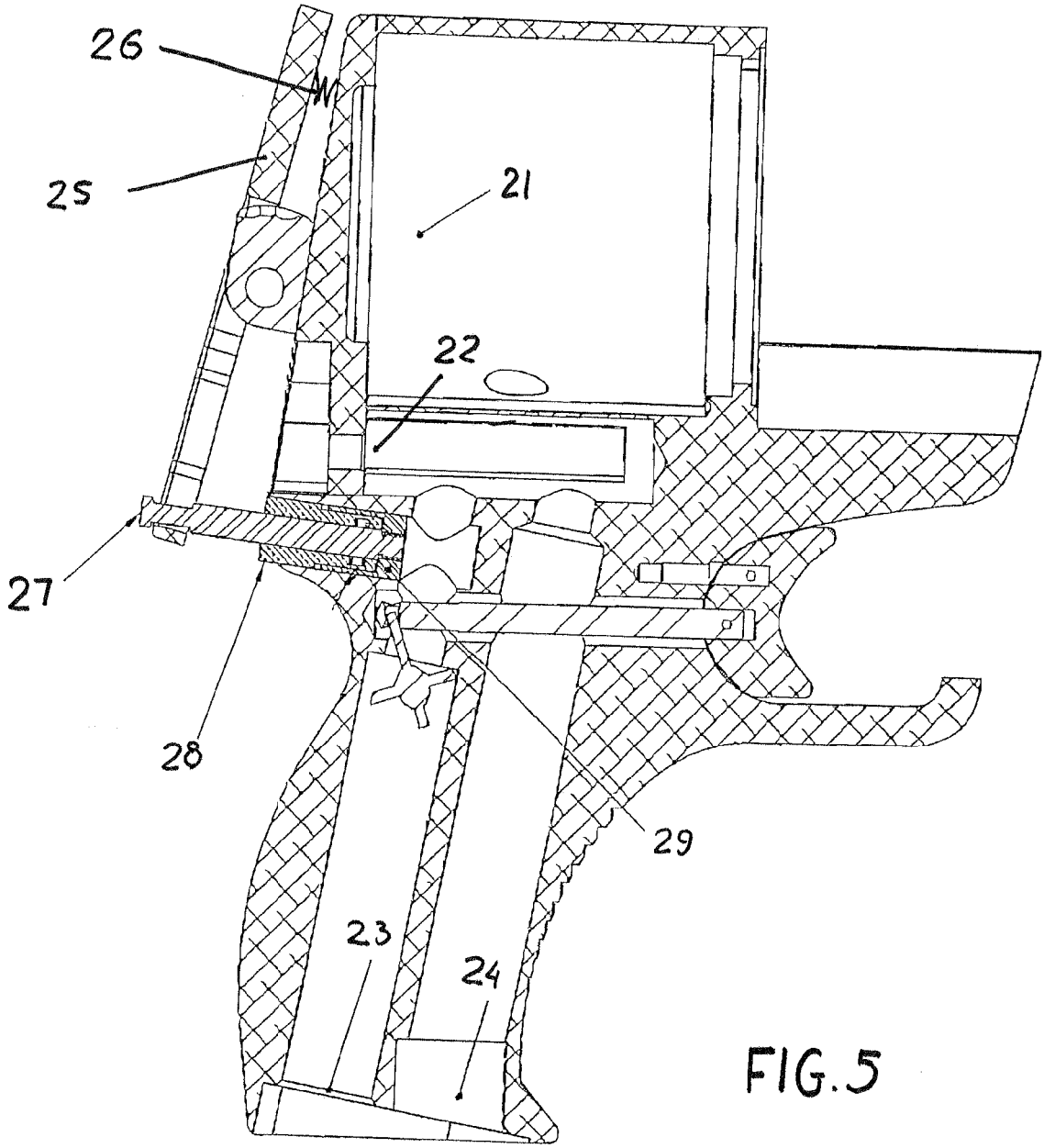
FIGS. 5 and 6 are views showing two positions of the safety device in accordance with another embodiment of the present invention.
Figure 6:
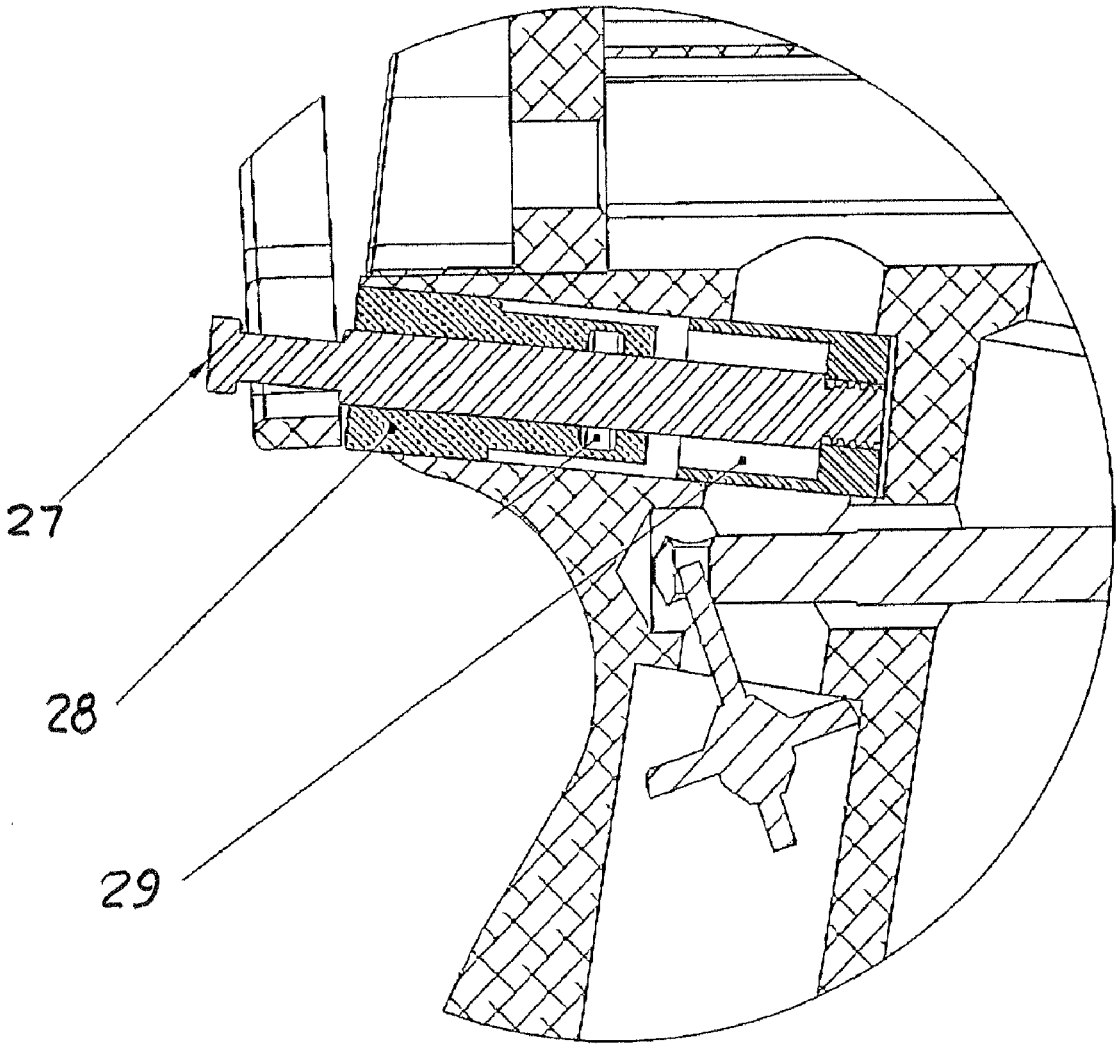

In order to displace the stem 27 with the piston 29 from the position shown in FIG. 5 to the position shown in FIG. 6, the operator must hold the hand grip 25 with his other hand and turn it, for example clockwise, so that the through going opening of the inlet passage 23 opens, the working fluid is supplied into the air motor 21 and the torque power wrench can function. When however the operator removes his other hand from the hand grip 25, the spring 26 pushes it counterclockwise, the inner leg of the hand grip 25 displaces the stem 27 with the piston 29 to the position shown in FIG. 6 in which the piston 29 closes the throughgoing opening of the inlet passage 23, the working fluid is no longer supplied into the motor 21, and the torque power wrench does not function.

It is believed to be clear that other embodiments are also possible for the safety device which is designed in accordance with the present invention, such that only when not only the one hand of the operator of the user holds the torque power wrench and pulls the trigger, but also when the other hand of the operator is used for operation of the torque power wrench, the torque power wrench functions. However, when the other hand of the operator is not used to activate a component of the torque power wrench, the torque power wrench stops functioning.

It will be understood that each of the elements described above, or two or more together, may also find a useful application in other types of constructions differing from the types described above.

While the invention has been illustrated and described as embodied in a torque power tool with reaction arm safety control, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. A hand-held torque power wrench for tightening and loosening fasteners, the torque power tool comprising a motor;

a housing;

at least one handle configured to hold the torque power wrench in a position with one hand of an operator and having a trigger to be pulled with the one hand of an operator; and a safety device operatable by the other hand of the operator, so that when it is operated by the other hand of the operator the torque power wrench is functioning to tighten or loosen the fastener, but when said only one hand of the operator is used for holding the torque power wrench in a position and pulling the trigger, the torque power wrench is not functioning to tighten or loosen the fastener.

2. A hand-held torque power tool as defined in claim 1, further comprising a reaction arm connectable with and disconnectable from said housing and configured to abut against an adjacent stationary object during the functioning of the torque power wrench so as to stop the torque power wrench from turning around the fastener during tightening or loosening of the latter, said safety device being configured so that said reaction arm is non-rotatably connected with said housing when said safety device is operated by the other hand of the operator and can divert a reaction force to the adjacent stationary object, but is disconnected from said housing when said safety device is not operated by the other hand of the operator and therefore, when disconnected, cannot divert a reaction force to the adjacent stationary object.

3. A hand-held torque power tool as defined in claim 2, wherein said safety device further includes a hand grip operatable by the other hand of said operator, so that when said grip is operated by the operator, said reaction arm is non-rotatably connected with said housing, but when said hand grip is released by the operator, said reaction arm is automatically disconnected from said housing.

4. A hand-held torque power tool as defined in claim 3, wherein said safety device includes an engaging element located substantially between said reaction arm and said housing and displaceable between a first position in which it non-rotatably connects said reaction arm with said housing and a second position in which it disconnects said reaction arm from said housing.

5. A hand-held torque power tool as defined in claim 4, wherein said safety device further includes spring means arranged so that when said hand grip is operated by the other hand of the operator, said element is moved from said second position into said first position, but when the other hand of the operator releases said hand grip, said spring means automatically displace said element back from said first position into said second position.

6. A hand-held torque power tool as defined in claim 4, wherein said engaging element is substantially ring shaped and has engaging formations which are permanently engageable with engaging formation of one of said housing and said reaction arm, and also engaging formations engagable with and disengagable from engaging formations of the other of said housing and said reaction arm in said first position and in said second position correspondingly.

7. A hand-held torque power tool as defined in claim 1, wherein said safety device is configured so that when it is operatable by the other hand of the operator, said motor is supplied with power, but when said only hand of the operator is used for holding the torque power wrench in position and pulling the trigger, said motor is not supplied with power and the torque power wrench is not functioning to tighten or loosen the fastener.

8. A hand-held torque power tool as defined in claim 7, further comprising means for supplying a working fluid to said motor for operating said motor and therefore functioning the torque power wrench, said safety device being configured so that when it is operatable by the other hand of the operator said means for supplying the working fluid supply the working fluid to said motor, but when said only one hand of the operator is used for holding the torque power wrench in position and pulling the trigger, said means to supplying the working fluid stop supplying the working fluid to said motor and the torque power wrench is not functioning to tighten or loosen the fastener.

9. A hand-held torque power tool as defined in claim 8, wherein said means for supplying the working fluid include a passage through which said working fluid is suppliable to said motor, and means for opening said passage or closing said passage when the other hand of the operator of the torque power wrench operates said safety device or does not operate said safety device correspondingly.

* * * * *